US006033834A

United States Patent [19]

Foster

[11] Patent Number: 6,033,834

[45] Date of Patent: Mar. 7, 2000

[54] BLEACH STARTER FOR COLOR PHOTOGRAPHIC PROCESSES

[75] Inventor: David George Foster, West Henrietta, N.Y.

[73] Assignee: Eastman Kodak Company, Rochester, N.Y.

[21] Appl. No.: 09/383,463

[22] Filed: Aug. 26, 1999

Related U.S. Application Data

[63] Continuation of application No. 08/183,390, Jan. 19, 1994.

[51] Int. Cl.[7] ..... G03C 7/44

[52] U.S. Cl. ..... 430/398; 430/450

[58] Field of Search ..... 430/450, 430, 430/398, 461

[56] References Cited

U.S. PATENT DOCUMENTS

| | | | |
|---|---|---|---|
| 3,256,092 | 6/1966 | Means et al. | 430/461 |
| 4,563,405 | 1/1986 | Ishikawa et al. | 430/393 |
| 4,948,711 | 8/1990 | Kojima et al. | 430/430 |
| 5,070,004 | 12/1991 | Fujita et al. | 430/393 |
| 5,176,988 | 1/1993 | Fujita et al. | 430/461 |
| 5,178,993 | 1/1993 | Fujita et al. | 430/389 |
| 5,215,872 | 6/1993 | Goto et al. | 430/387 |
| 5,217,852 | 6/1993 | Morigaki et al. | 430/372 |

*Primary Examiner*—Hoa Van Le

*Attorney, Agent, or Firm*—Sarah Meeks Roberts; J. Lanny Tucker

[57] ABSTRACT

A method of preparing a bleaching solution for a photographic element comprising combining a photographic bleach starter comprising sodium acetate, potassium acetate or ammonium acetate with a photographic solution having bleaching ability.

10 Claims, No Drawings

BLEACH STARTER FOR COLOR PHOTOGRAPHIC PROCESSES

CROSS-REFERENCE TO RELATED APPLICATION

This is a continuation of application Ser. No. 08/183,390 filed Jan. 19, 1994.

FIELD OF THE INVENTION

This invention relates to processing a silver halide color photographic element, and more specifically to bleaching a silver halide photographic element.

BACKGROUND OF THE INVENTION

Color silver halide photographic elements are generally processed by the steps of development, desilvering and washing and/or stabilization. In the color development step, the exposed silver halide is reduced with a color developing agent to generate silver whereupon the oxidized color developing agent reacts with a color coupler to provide a dye image. It is then necessary to remove the silver image which is formed coincident with the dye image. This can be done by oxidizing the silver using an oxidizing agent, known as a bleaching agent, in the presence of halide ion to form silver halide. The silver halide is then dissolved using a a silver halide solvent, commonly referred to as a fixing agent. Alternatively, the bleaching agent and fixing agent can be combined in a bleach-fixing solution and the silver removed in one step.

The above described desilvering process can be carried out in either a continuous or batch mode of processing. In the batch mode, all or part of the processing solutions are replaced whenever the amount of film processed reaches a predetermined quantity. In the continues mode, replenisher solutions are added to the processing solutions in an amount proportional to the amount of film processed. Such replenishment is generally expressed in milliliters per square foot or milliliters per number of rolls of film processed.

The pH of the developer must be alkaline in order for proper development to occur. In contrast, the pH of the bleach must by acidic. In some processing systems there is a stop bath in between the developer and the bleach which serves to modify the alkalinity of the developer. However, many modern bleaches act as both a stop bath and a bleach for metallic silver. It is therefore necessary to use bleach replenishers which have a lower pH then the bleach tank solutions into which they are replenished. This is done in order to offset the alkaline developer solution which is carried over into the bleach solution by the photographic element. Thus, the bleaching tank solution is generally of higher pH than the bleach replenisher solution.

To start up either a batch or replenished system it is necessary to make a bleach tank from a bleach replenisher solution. Bleach replenisher solutions are insufficient to provide desired photographic performance. When starting bleach tanks are prepared, a solution commonly known in the photographic industry as a "bleach starter" is added to the bleach replenisher solution. Water may also by added. The purpose of the bleach starter is to increase the pH of the bleach replenisher to the desired pH of the starting bleach tank solution.

Typically bleach starters are alkaline. Known bleach starters include ammonia, ammonium hydroxide, potassium hydroxide, potassium carbonate, and sodium hydroxide. U.S. Pat. Nos. 5,176,988 and 5,070,004 describe a bleach starter that contains an imidazole or a primary or secondary amine having a hydroxyalkyl radical as an alkaline agent. U.S. Pat. No. 5,217,852 discusses the use of many common alkali agents that may be used as bleach starters including potassium carbonate, ammonia water, imidazole, monoethanolamine or diethanolamine. U.S. Pat. Nos. 5,215,872, and 5,178,993 describe adjusting solutions which have bleaching ability with various alkali agents including potassium hydroxide, sodium hydroxide, imidazole, monoethanolamine, diethanolamine, imidazole, and most preferably aqueous ammonia.

Although all of the above mentioned alkaline agents are able to adequately adjust the pH of the bleach replenisher solution to that of a starting bleach tank, they all are undesirable due to odor or safety problems. Ammonia water, ammonium hydroxide and many amines cause an unpleasant odor themselves, or when mixed with the acidic replenisher solution. Other alkali agents, such as potassium hydroxide, cause undesirable precipitation when mixed with bleach replenishers, while agents such as potassium carbonate cause unwanted effervescence or foaming.

Thus, there is a need for a bleach starter that effectively adjusts the pH of a bleach replenisher solution without concomitant odor, precipitation, effervescence or safety problems.

SUMMARY OF THE INVENTION

This invention provides a method of preparing a bleaching solution for a photographic element comprising combining a photographic bleach starter comprising sodium acetate, potassium acetate or ammonium acetate with a photographic solution having bleaching ability.

The bleach starter used in this invention allows the preparation of photographic bleaching solutions without the problems of odor, precipitation, safety or effervescence. The versatility of these compounds for use as starters is that they can be added to the bleach replenisher solution as either a solid or in a water solution. This is advantageous over previous bleach starters used in the photographic industry which have characteristically been used in aqueous solutions only. This invention also provides a method for processing silver halide color photographic elements using a bleach starter which permits desirable processing with acceptable photographic processing performance.

DETAILED DESCRIPTION OF THE INVENTION

The bleach starter used in this invention is sodium acetate, potassium acetate, or ammonium acetate. These compounds may be used singly or in combination. They may be used either as solids or in aqueous solutions. When used in aqueous solutions the concentration of the compounds may be from about 0.1 mole/liter to the solubility limit of the compound. Preferably higher concentrations are used to reduce packaging and needed quantities. The pH of the aqueous bleach starter is preferably from 7.0 to 10.5.

The bleach starter is combined with a solution having a bleaching function (generally a bleach replenisher) prior to processing a color silver halide photographic element. The bleach starter is added to the bleach replenisher until the replenisher reaches the desired pH to be used during processing. Water or other bleaching components may also be added to the bleach replenisher.

The bleaching replenishers used in this invention contain a bleaching agent. Bleaching agents include compounds of polyvalent metal such as iron (III), cobalt (III), chromium (VI), and copper (II), peracids, quinones, and nitro compounds. Typical bleaching agents are iron (III) salts, such as ferric chloride, ferricyanides, bichromates, and organic complexes of iron (III) and cobalt (III). Ferric complexes of aminopolycarboxylic acids and persulfate are most commonly used as bleach agents with ferric complexes of aminopolycarboxylic acids being preferred. Some examples of useful ferric complexes include complexes of:

nitrilotriacetic acid,
ethylenediaminetetraacetic acid,
propylenediamine tetraacetic acid,
diethylenetriamine pentaacetic acid,
ortho-diamine cyclohexane tetraacetic acid,
ethylene glycol bis(aminoethyl ether)tetraacetic acid,
diaminopropanol tetraacetic acid,
N-(2-hydroxyethyl)ethylenediamine triacetic acid,
ethyliminodipropionic acid,
methyliminodiacetic acid,
ethyliminodiacetic acid,
cyclohexanediaminetetraacetic acid
glycol ether diamine tetraacetic acid.

Preferred aminopolycarboxylic acids include 1,3-propylenediamine tetraacetic acid, methyliminodiactic acid and ethylenediamine tetraacetic acid. The bleaching agents may be used alone or in a mixture of two or more; with useful amounts typically being at least 0.1 moles per liter of bleaching solution, with at least 0.5 moles per liter of bleaching solution being preferred.

In addition, water-soluble aliphatic carboxylic acids such as acetic acid, citric acid, propionic acid, hydroxyacetic acid, butyric acid, malonic acid, succinic acid and the like may be utilized in any effective amount. Useful amounts are typically at least 0.35 moles per liter of bleaching solution, with at least 0.7 moles being preferred and at least 0.9 moles being most preferred.

These ferric aminopolycarboxylate complexes are used in the form of salts, for example as sodium, potassium, or ammonium salts. The bleaching solutions may contain other addenda known in the art to be useful in bleaching compositions, such as sequestering agents, sulfites, non-chelated salts of aminopolycarboxylic acids, bleaching accelerators, re-halogenating agents, anti-calcium agents, and/or anti-phosphate agents.

The bleaching solution is generally used at a pH of 0.45 to 9.0, more preferably 4.0 to 6.8, and most preferably 4.0 to 5.5. The bleach replenisher solution is generally at a pH of 0.2 to 8.75, more preferably 3.25 to 5.0 and is adjustable to the pH range of the bleaching solution by adding the bleach starter.

The solutions having a bleaching function are included in the processing procedures as shown below:

(1)development→bleaching→fixing
(2)development→bleach fixing
(3)development→bleach fixing→fixing
(4)development→bleaching→bleach fixing
(5)development→bleaching→bleach fixing→fixing
(6)development→bleaching→washing→fixing
(7)development→washing or rinsing→bleaching→fixing
(8)development→washing or rinsing→bleach fixing
(9)development→fixing→bleach fixing The above mentioned bleach and fixing baths may have any desired tank configuration including multiple tanks, counter current and/or co-current flow tank configurations.

A stabilizer bath is commonly employed for final washing and hardening of the bleached and fixed photographic element prior to drying. Alternatively, a final rinse may be used. A bath can be employed prior to color development, such as a prehardening bath, or the washing step may follow the stabilizing step. Other additional washing steps may be utilized. Additionally, reversal processes which have the additional steps of black and white development, chemical fogging bath, light re-exposure, and washing before the color development are contemplated. In reversal processing there is often a bath which precedes the bleach which may serve many functions, such as an accelerating bath, a clearing bath or a stabilizing bath. Conventional techniques for processing are illustrated by Research Disclosure, Paragraph XIX.

The bleaches of this invention may be used with any compatible fixing solution. Examples of fixing agents which may be used are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); or a thiourea. These fixing agents can be used singly or in combination. Thiosulfate is preferably used in the present invention.

The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. The element may also contain a magnetic backing such as described in No. 34390, *Research Disclosure*, November, 1992.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. No. 5,176,991 (Jones et al); U.S. Pat. No. 5,176,992 (Maskasky et al); U.S. Pat. No. 5,178,997 (Maskasky); U.S. Pat. No. 5,178,998 (Maskasky et al); U.S. Pat. No. 5,183,732 (Maskasky); and U.S. Pat. No. 5,185,239 (Maskasky) and (100) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F, and G and the publications cited therein. These couplers can be incorporated in the elements and emulsions as described in Research Disclosure Section VII, paragraph C and the publications cited therein.

The photographic elements of this invention or individual layers thereof can contain among other things brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI) and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The color developing solutions typically contain a primary aromatic amino color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediamine monohydrochloride, 4-N,N-diethyl-2-methylphenylenediamine monohydrochloride, 4(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate.

In addition to the primary aromatic amino color developing agent, color developing solutions typically contain a variety of other agents such as alkalies to control pH, bromides, iodides, benzyl alcohol, anti-oxidants, antifoggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

The following examples are intended to illustrate, without limiting, this invention.

EXAMPLES

The following bleach replenisher (pH=4.50), water and various bleach starters were used to make fresh bleaching tank solutions having a pH of 4.75. The bleach starters are described in Table I and were added as aqueous solutions until the desired pH was reached.

| Bleach Replenisher | |
|---|---|
| liters of water | 0.58 |
| grams 1,3-PTDA | 43.01 |
| mls NH4OH (57%) | 80.5 |
| mls HOAc | 92 |
| grams Rexpronal Acid | 0.92 |
| grams NH4BR | 28.75 |
| grams Fe(NO3)3*9H2O in 290 mls Water | 51.58 |
| Adjusted to pH 4.50 | |

The bleach solutions were tested in various small processors. Where foaming occurred, if the bleach starter was added in one portion, the foaming would start immediately. If the starter was added slowly, the foaming started immediately upon normal agitation. If a precipitation was noted, it would form in the first ten minutes, often immediately. Precipitants formed both in the bleach solution and on the sides of the tank. The results are shown in Table 1.

TABLE 1

Comparison of Various Bleach Starters

| Bleach Starter | Odor | Precipitation | Foaming or Effervescence | Remark |
|---|---|---|---|---|
| Ammonia Water 27% solution | Yes | No | No | Comparison |

TABLE 1-continued

Comparison of Various Bleach Starters

| Bleach Starter | Odor | Pre-cipitation | Foaming or Effervescence | Remark |
|---|---|---|---|---|
| Ammonium Hydroxide 28–30% solution | Yes | No | No | Comparison |
| Potassium Hydroxide 85% solution | Slight | Yes | No | Comparison |
| Potassium Carbonate 47% solution | No | No | Yes | Comparison |
| Sodium Acetate 4.0 M | No | No | No | Inventive |
| Potassium Acetate 4.0 M | No | No | No | Inventive |
| Ammonium Acetate 4.0 M | No | No | No | Inventive |

The data of Table 1 illustrates that the use of sodium acetate, potassium acetate and ammonium acetate eliminates all of the common problems associated with conventional bleach starters.

While the invention has been described in detail and with reference to specific embodiments thereof, it will be apparent to one skilled in the art that various changes and modifications can be made therein without departing from the spirit and scope thereof.

What is claimed is:

1. A method of preparing a bleaching solution having a pH of from 0.45 to 6.8 that is to be used for processing a photographic element comprising adding a photographic bleach starter having a pH of 7.0 to 10.5 and comprising sodium acetate, potassium acetate or ammonium acetate at a concentration of 0.1 mol/l to the solubility limit of said acetate to a bleach replenisher until said bleach replenisher reaches the desired pH to be used during processing, said bleach replenisher comprising as a bleaching agent a ferric complex of an aminopolycarboxylic acid in an amount of at least 0.1 mol/l of bleaching solution, and a water-soluble aliphatic carboxylic acid as a buffer in an amount of at least 0.35 mol/l of bleaching solution.

2. The method of claim 1 wherein the bleach starter is a solid.

3. The method of claim 1 wherein the bleach starter is an aqueous solution of sodium acetate.

4. The method of claim 1 wherein said ferric complex is a ferric complex of nitrilotriacetic acid, ethylenediaminetetraacetic acid, propylenediamine tetraacetic acid, diethylenetriamine pentaacetic acid, orthodiamine cyclohexane tetraacetic acid, ethylene glycol bis(aminoethyl ether) tetraacetic acid, diaminopropanol tetraacetic acid, N-(2-hydroxyethyl)ethylenediamine triacetic acid, ethylenediaminedisuccinic acid, ethyliminodipropionic acid, methyliminodiacetic acid, cyclohexanediaminetetraacetic acid or glycol ether diamine tetraacetic acid.

5. The method of claim 1 wherein said ferric complex is present in said bleaching solution in an amount of at least 0.5 mol/l.

6. The method of claim 1 wherein said aliphatic carboxylic acid is present in an amount of least 0.7 mol/l.

7. The method of claim 1 wherein the pH of said bleach replenisher is from 0.2 to 8.75.

8. The method of claim 7 wherein the pH of said bleach replenisher is from 3.25 to 5.0.

9. The method of claim 1 wherein said bleaching solution has a pH of from 4.0 to 6.8.

10. The method of claim 9 wherein said bleaching solution has a pH of from 4.0 to 5.5.

* * * * *